US006098220A

United States Patent [19]

Momma

[11] Patent Number: 6,098,220

[45] Date of Patent: Aug. 8, 2000

[54] SWINGING PILLOW

[76] Inventor: Koji Momma, 4-19-16, Miyagi, Urazoe-Shi, Okinawa-Ken, Japan

[21] Appl. No.: 09/412,744

[22] Filed: Oct. 5, 1999

Related U.S. Application Data

[63] Continuation of application No. 09/010,854, Jan. 22, 1998, abandoned.

[51] Int. Cl.[7] ..... A47G 9/00

[52] U.S. Cl. ..... 5/636; 5/639; 5/641; 5/904; 5/951

[58] Field of Search ..... 5/636, 637, 638, 5/639, 641, 904, 951

[56] References Cited

U.S. PATENT DOCUMENTS

| | | | |
|---|---|---|---|
| 2,880,428 | 4/1959 | Forsland | 5/636 |
| 3,512,605 | 5/1970 | McCorkle | 5/904 X |
| 3,638,255 | 2/1972 | Sterrett | 5/641 |
| 4,042,791 | 8/1977 | Wiseman | 5/904 X |
| 4,345,347 | 8/1982 | Kantor | 5/636 X |
| 4,977,634 | 12/1990 | Koji | 5/641 X |
| 5,123,133 | 6/1992 | Albert | 5/904 X |
| 5,357,642 | 10/1994 | Clute | 5/904 X |
| 5,363,523 | 11/1994 | Blackburn | 5/639 X |
| 5,363,524 | 11/1994 | Lang | 5/951 X |
| 5,571,155 | 11/1996 | Bastille | 5/951 X |
| 5,706,535 | 1/1998 | Takashima | 5/641 X |
| 5,732,426 | 3/1998 | Furuya et al. | 5/641 X |
| 5,819,347 | 10/1998 | Masuda | 5/641 |
| 5,819,743 | 10/1998 | McMillin et al. | 5/636 X |
| 5,918,333 | 7/1999 | Takashima | 5/641 |
| 5,974,607 | 11/1999 | Smith | 5/636 |

FOREIGN PATENT DOCUMENTS

| | | | |
|---|---|---|---|
| 40/5161532 | 6/1993 | Japan | 5/641 |
| 7-275099 | 10/1995 | Japan | A47G 9/00 |
| 8-164049 | 6/1996 | Japan | A47G 9/00 |
| 9-98870 | 4/1997 | Japan | A47G 9/00 |
| 10-108771 | 4/1998 | Japan | A47G 9/00 |

*Primary Examiner*—Terry Lee Melius
*Assistant Examiner*—Robert G. Santos
*Attorney, Agent, or Firm*—Michael D. Bednarek; Shawpittman

[57] ABSTRACT

The swinging pillow has a shape which can maintain the proper position of a user's backbone and can facilitate the user's turning over onto his side. The pillow can have a built-in sound source in its interior so that the pillow can be used also for relaxation or for the purpose of treatment sleeping disorders, such as sleeplessness, and has a function equal to or near that of an earphone or headphone, without employing such devices. The swinging pillow comprises a pillow body for accepting a user's head and left and right rising portions formed, respectively, as rising end portions positioned at both ends of the pillow body extending in a direction of a user's shoulder-width. The pillow is curved as a whole, being generally U-shaped, thus, the whole portion of the pillow functions as a pillow. Within the inside of at least one of the left and right rising portions, there can be provided a sound source.

26 Claims, 12 Drawing Sheets

SWINGING PILLOW

This application is a continuation of Ser. No. 09/010,854 filed Jan. 22, 1998, now abandoned.

FIELD OF INVENTION

The present invention relates to a swinging pillow suitable for use in sleeping, relaxation and for the purposes of physical therapy.

BACKGROUND OF INVENTION

There have been pillows that have been proposed being generally formed into a U-shape having a concave portion for receiving the back of a user's head so as to give comfortable feeling in bed. Such an example is described in Japanese Utility Model Publication No. 6-36789. Also, a U-shaped pillow designed to substantially cover both the head and ears of a human body designed to protect against cold temperatures has been described in Japanese Un-examined Utility Model Laid-Open No. 64-35966.

In the former, however, there is the possibility that the user's head will become dislodged as the user turns over in bed. Further, it is difficult for this pillow to restore and maintain the disordered line of the user's backbone.

In the latter, the U-shaped pillow is effective for protecting ears against the cold in the winter season or in cold climates. In a milder climate, however, its user may feel too warm and, thus may not be suitable for use. Further, the outer portions of ears may frequently adhere to those features, which results in a constrained feeling and prevents the user from obtaining a pleasant sleep.

Turning over in bed promotes blood circulation and is preferable, from the viewpoint of health. Accordingly, there exists a desire for a pillow which makes turning over easy, does not disorder a user's backbone line, and gives a comfortable sleep.

Further, from the viewpoint of the physical therapy, the pillow can facilitate the maintenance of user relaxation by the selection, inclusion and use of audio of selected frequencies or desirable music, which may encourage the generation of the beneficial alpha waves that are found in the user's brain, thus effectuating ease of sleep for the user.

Such sound or music is innocuous in its effect on others who are nearby when a user listens to it alone in bed. However, it may be an annoyance to a third parties nearby who do not desire such sound or music. Even so, it is inconvenient to wear an earphone or headphone, and it may be impossible to sleep with an earphone or headphone on the user's head.

The present invention has been designed in consideration of the above-described problems. An object of the present invention is to provide a swing type pillow having a form which maintains a user's backbone line in a straight position and makes turning over easy. Another object of the invention is to provide a technique in which a pillow has a built-in sound source in its interior so that the pillow can be also used for relaxation or for the purpose physically treating such problems as those involving sleeplessness, and which is also functionally equivalent to or near equivalent to the functioning of an earphone or headphone, without the need to employ such devices.

SUMMARY OF THE INVENTION

According to the present invention, a swinging pillow is concaved so that lower surface and upper surface receive a user's head and is generally semi-circular in shape. It is shaped with sufficient spaces between inner surface of the upper ends of the pillow and the user's ears when the user lies on his side, thus the whole portion of the semi-circular concave pillow functions as a pillow. Here, the phrase "whole portion of the semi-circular concave pillow functions as a pillow" means not only that a central portion of the pillow can be used, but also both end portions of the semi-circular concave pillow can be used for receiving a user's head (sleeping person) when he lies on his side.

Thus, the pillow is of a semi-circular concave shape, all of which functions as a pillow, being upwardly opened when a user lies on his back. When a user turns over to lie on his side, the semi-circular concave pillow swings together with the user's head so that the semi-circular concave pillow is opened toward one side, maintaining its generally U-shape.

Even when a user lies on his side, he neither falls out of the pillow nor assumes an unnatural posture since the whole portion of the pillow functions as a pillow. Accordingly, the user can have as good a sleep as in the case when he lies on his back. Thus, the pillow according to the present invention is one suitable for turning over, for promoting circulation of blood, and having a therapeutic effect on the user's backbone.

The pillow of the present invention has the semi-circular concave shape, and therefore, when a user lies on his back, the lower surfaces of both sides of the pillow are spaced above the floor and both shoulders of the user are lifted so that it has an effect of removing the strain of the shoulders. Further, because of its semi-circular concave shape, it has an effect of preventing its displacement, which has a tendency to make the user's head fall out of the pillow, which is of particular concern for a person who tosses to some degree in his sleep, including those with aggravated sleeping disorders.

According to this invention, when viewed from a profile section taken along a spinal column of a user, an area of the pillow on the side receiving the back of a neck of a user is higher than the other areas. Because of this construction, the pillow not only contributes to the stability of the head and a comfortable feeling in bed when a user lies on his back, but also makes the back of the neck curved forwardly in its proper shape, giving a therapeutic effect while the user sleeps.

A lower side of a central portion of the pillow is a convex arc.

While the pillow of the present invention is semi-circular and concave as a whole, there are two types of configurations of its outer bottom surface, which is the lower side of the central portion of the semi-circular concave pillow. These configurations include a convex arc and a horizontal surface.

In the case that the lower side of the central portion of the pillow is a convex arc, when a user turns over to lie on his side, the pillow can easily swing together with the turning of the user's head. Thus, it is easy for the semi-circular concave pillow of this type swings or turns.

In this case when the lower side of the central portion of the pillow is horizontal, the stability of the pillow is good when a user lies on his back. In stead, this pillow needs more strength to swing or turn when a user turns over to lie on his side.

Accordingly, it must be decided at the time of pillow design and manufacture which of the convex arc and horizontal surface is selected for the lower side of the central portion of the semi-circular concave pillow. Even in the case when the horizontal shape is employed, it may have the almost same effect as the arc when the cross-sectional area of the horizontal shape is narrow.

When the lower surface of the pillow is a concaved arc, the pillow swings or turns in a direction just perpendicular to the spinal column of the user when it swings along with the user's turning over or the like. Thus, the pillow is not displaced as it swings, thus, the user can sleep with a normal posture.

The lower inside of the pillow can be made of hard synthetic resin and another portion can have a layer of softer synthetic resin, at least on an upper side of the pillow.

In this case, the structure and shape of the pillow can be held fixedly, because of the inside the pillow made of harder synthetic resin. On the other hand, a user's head contacts with the upper surface covered with softer synthetic resin so that stimulation given to the backs of the neck and head of the user is not too severe and uncomfortable Further, by selecting the thickness of the soft synthetic resin portion, the degree of the stimulation can be easily set.

The swinging pillow can be formed so that a plurality of projections are formed on an upper surface of the pillow for stimulating effective pressure points of a user. In this case that plurality of projections are formed on the upper surface of the pillow for stimulating effective pressure points. These projections stimulate effective pressure points in the backs of the user's neck and head when the semi-circular concave pillow swings, thus promoting the blood circulation and increasing therapeutic effect further.

Further, according to another aspect of the present invention, a swinging pillow comprises a pillow body for accepting a user's head, and left and right rising portions formed respectively as rising end portions positioned at ends of the pillow body in a direction of the width of a user's shoulders; wherein: the pillow is curved as a whole to be generally U-shaped, thus, the whole portion of the pillow functioning as a pillow; and within an inside of at least one of the left and right rising portions, there is provided a sound source. By this construction, the sound source can be used for transition to relaxation, for treatment purpose of solving sleeplessness, or the like. In addition, by effectively utilizing the pillow body or the left and right rising portions for the sound source, low sound or musical pieces also can serve these purposes.

In that case, it is preferable that, when a user lies on his back with his head being received by said pillow body, there exist sufficient spaces between inner surfaces of the left and right rising portions and ears of the user. By this, the pillow does not give a blocked feeling or oppressive feeling, even if there exist both rising portions.

Further, it is also very preferable that insides of the left and right rising portions are made hollow and there is provided one or more openings at those rising portions for leading sound from the sound source to the outside. By this construction, even if the sound from the speakers is made very low, it can be led to the outside without being so lowered furthermore that a user can not listen to it.

Further, the openings may be preferably provided in the inner surfaces of the rising portions closely to user's ears. By this, low sound can be listened to in the neighborhood of both ears, and therefore the pillow can function like a headphone.

Although one opening may be used, it is preferable that a plurality of smaller openings are provided, since the smaller openings can prevent intrusion of foreign body, etc.

Further, as the sound source, it is preferable to use speakers which can reproduce various sounds or musical pieces serving the purpose. Further, it is more preferable to provide those speakers closer to the openings so that even low sound is effectively led to the outside.

Further, as the sound source, there may be provided an amplifier connected to the speakers. The amplifier may be housed within the pillow body or the rising portion.

Further, the sound source may be provided with a manipulating portion including a volume adjusting means for the speakers, a band switching means, or the like, and the manipulating portion may be provided at one of the rising portions.

Further, there may be provided on-off means for turning off the sound source when the user turns over. By this, even when a user falls asleep while playing sound or a musical piece, power can be turned off in the course of sleeping. Instead of the on-off means, a timer may be provided. According to claim 20 and 21, (a) weight(s) is(are) provided in said lower portion of the pillow. By the swinging pillow according to claim 20, the user can turn to lay on his back easily.

Further, according to claims 22–26 a buckwheat-chaff(s), a paddy chaff(s), a charcoal, an activated carbon(s), or a tip(s) of Japanese cypress is(are) filled with an inner portion of the pillow. By the swinging pillow according to claims 22–26, the user can sleep healthy and pleasant.

DETAILED DESCRIPTION

The embodiments of the present invention are set forth below in a manner in which to described and illustrate the swinging pillow and its use.

Embodiment 1

Figure 1:
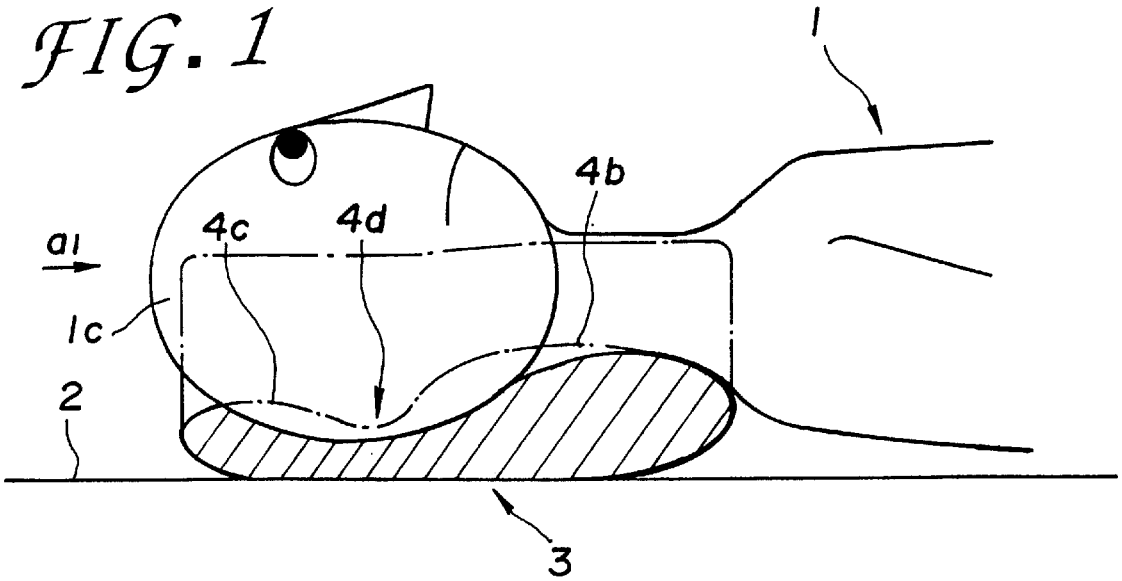
FIG. 1 is a sectional view of an embodiment of the swinging pillow of the present invention, taken along a spinal column of a user.
Figure 2:
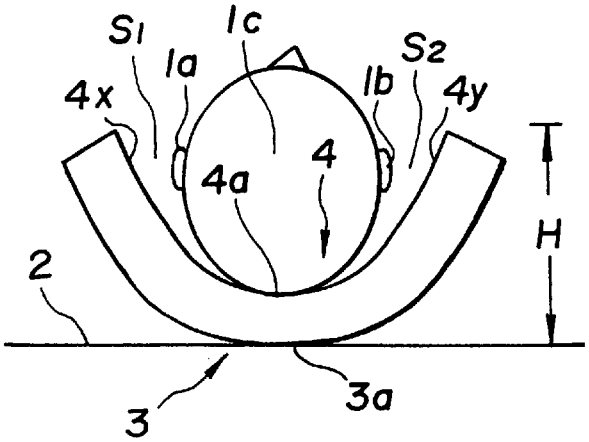
FIG. 2 is a rear view seen from the side of a user as shown by the direction of the arrow (a1)
Figure 3:
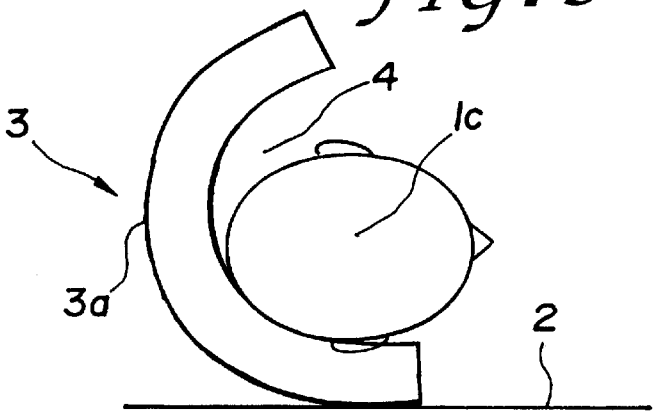
FIG. 3 is a rear view showing a state in which a user has turned over to lie on his side.

FIG. 1 is a sectional view showing an embodiment of the swinging pillow, according to the present invention, taken along a spinal column of a user, and showing a state of use. FIG. 2 is a rear view seen from the side of a user as shown by the direction of the arrow (a1). FIG. 3 is a rear view showing a state in which a user has turned over to lie on his side.

As shown by FIG. 2, seen from the rear side or the front side, i.e., the side of feet of a sleeping body 1, the pillow of the present invention is concaved in shape so that each of its lower surface 3 in contact with a floor 2 and upper surface 4 accepting a head of a user is generally semi-circular in shape. The pillow is gradually opened upwardly so that, when the human body (user) 1 use the pillow lying on his back, there are sufficient spaces S1, S2 between the inner surfaces 4*x,* 4*y* of the upper ends of the pillow and the ears 1*a,* 1*b* of the user.

As shown by FIGS. 1 and 2, when a user lies on his back, the pillow accepts the head 1*c* of the user at its center portion, i.e., lowest portion 4*a* of the semi-circular concave portion. Thus, owing to the semi-circular concave shape of the pillow, even when the pillow is shifted in some degree, or even when a human body moves to change his posture, his head does not drop out of the pillow. Accordingly, the pillow is suitable also for one who tosses in some degree in his sleep, including one with an aggravated sleeping disorder.

Further, when a user turns over to lie on his side, the pillow swings to the state of FIG. 3 because of the weight of the user's head. Thus, even when the user lies on his side, he does not drop out of the pillow and the pillow continues to serve its function. Because of such construction, the pillow serves at all portions, not only at the center of the semi-circular concave shape, but also up to both end portions 4*x,* 4*y* at a height H.

Figure 5:
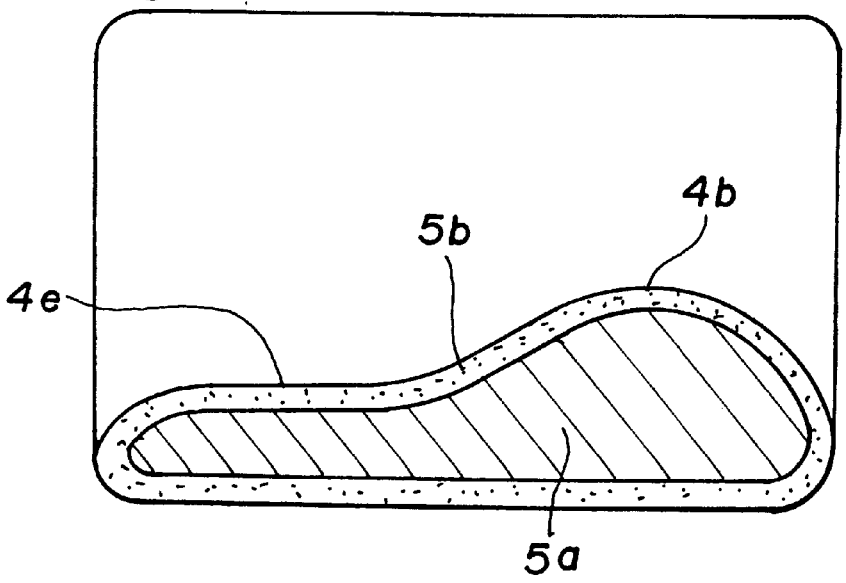
FIG. 5 is a sectional view showing the second embodiment of FIG. 4, taken along a spinal column of a user.

For example, as shown by FIGS. 1 and 5, in the case that, in the upper surface 4 of the semi-circular concave shape, there exist a higher mountain-like portion 4*b* on the front side (i.e., the side closer to feet of a user) of the pillow, a lower mountain-like portion 4*c* on the rear side, and a valley portion 4*d* between these mountain-like portions, the pillow has a two-mountain profile in section at any portion up to the inner surface 4*x,* 4*y* of both ends.

For a common shape of a human head, the shape shown in FIG. 1 is effective, having the higher mountain-like portion 4*a* on the front side, the lower mountain-like portion 4*c* on the rear side, and the valley portion 4*d* between both mountain-like portions, in section taken along a spinal column. This shape fits backs of a neck and head, and the back of the neck is stimulated by the higher mountain-like portion 4*b,* which contributes to a good sleep. In addition, therapeutic effect can be expected because of stimulation of effective pressure points.

Embodiment 2

Figure 4:
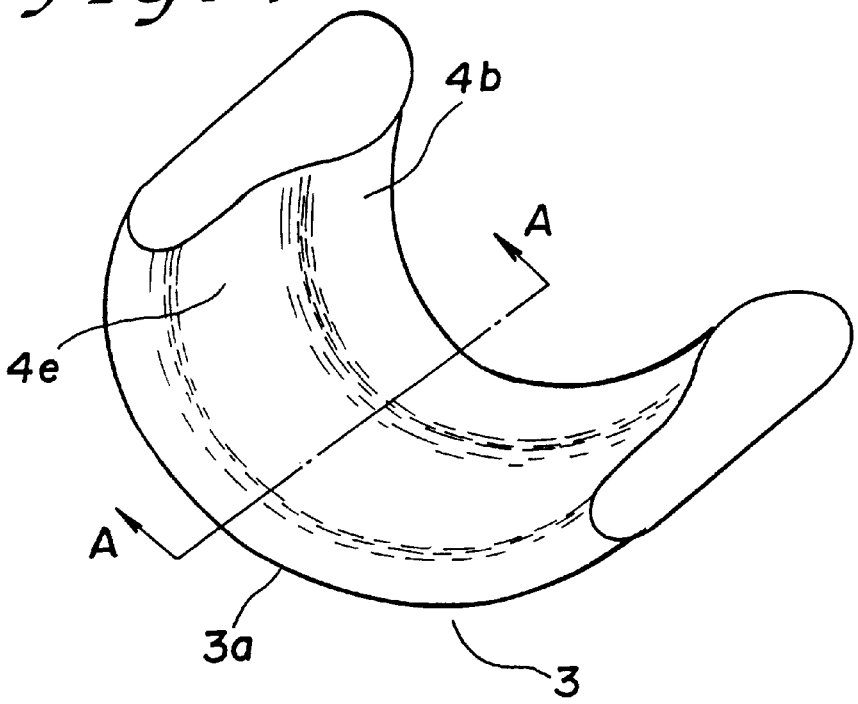
FIG. 4 is a perspective view showing a second embodiment of the swinging pillow of the present invention.

For some shapes of a head, however, it is preferable that the pillow does not have the lower mountain-like portion as shown by FIG. 4. Namely, the pillow of FIG. 4 does not have the valley portion 4*d* of FIG. 1, although it has the higher mountain-like portion. Thus, the pillow is suitable for a deformed head, having the higher mountain-like portion 4*b* as an area for receiving a back of a neck, with the other area 4*e* being of a flat shape without a mountain or valley.

As shown by FIG. 5, it is preferable that an inner body 5*a* of the pillow is made of harder synthetic resin, and at least upper surface 5*b* of the pillow is made of softer synthetic resin. Thus, the structure and shape of the pillow can be held fixedly, because of the inside the pillow made of harder synthetic resin 5*a*. On the other hand, a user's head contacts with the upper surface covered with softer synthetic resin 5*b* so that stimulation given to the backs of the neck and head of the user is not too strong. Not only the upper surface but also the whole surface of the pillow may be covered with a layer of softer synthetic resin.

Figure 9:
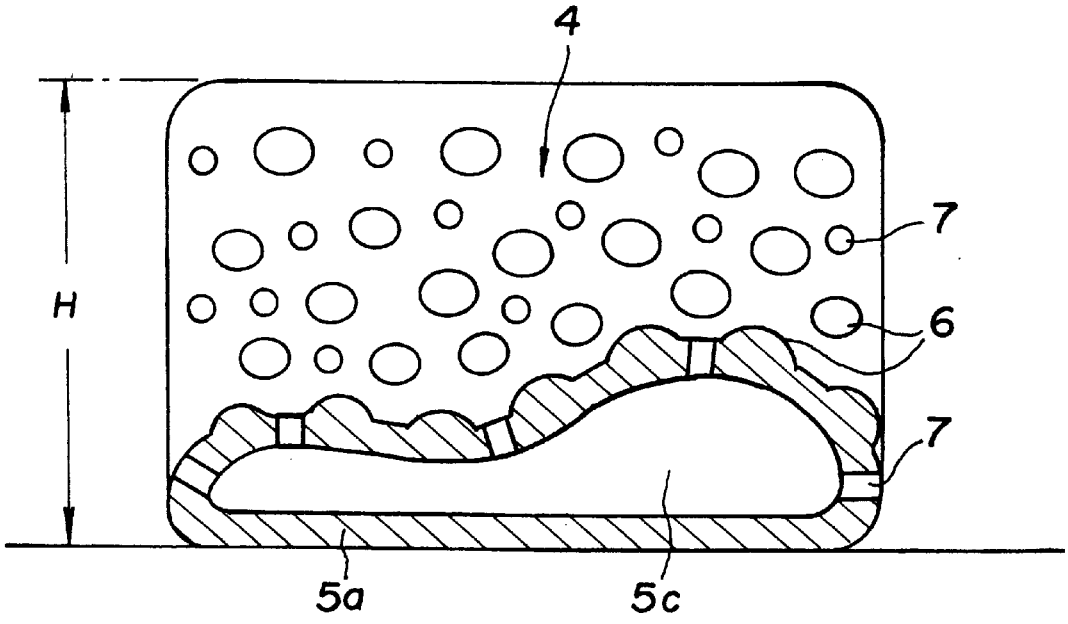
FIG. 9 is a sectional view showing an embodiment provided with bumps, taken along a spinal column of a user.

It is preferable that, as described before, when a user lies on his side, the pillow easily swings to lie sideways in a posture of C-shape. When the inside of the pillow is fully filled with hard synthetic resin, the pillow may be too heavy to swing. In that case, the pillow may be lightened by making the inside 5*c* hollow as shown by FIG. 9.

Embodiment 3

Figure 6:
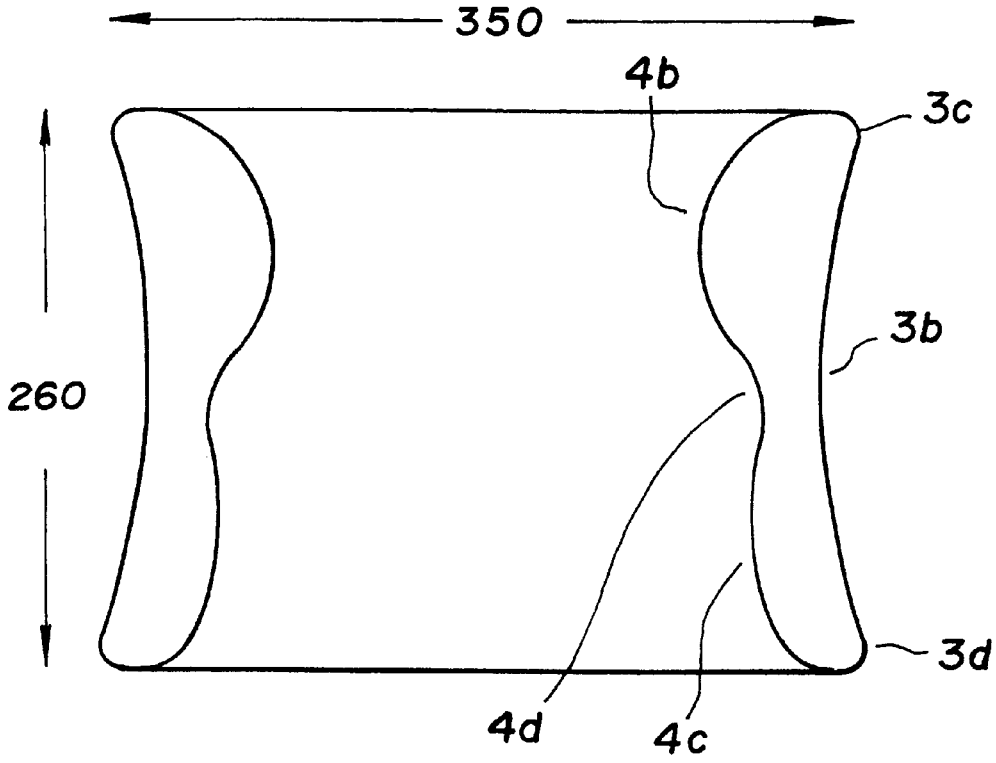
FIG. 6 is a plan view showing a third embodiment of the swinging pillow of the present invention.
Figure 7:
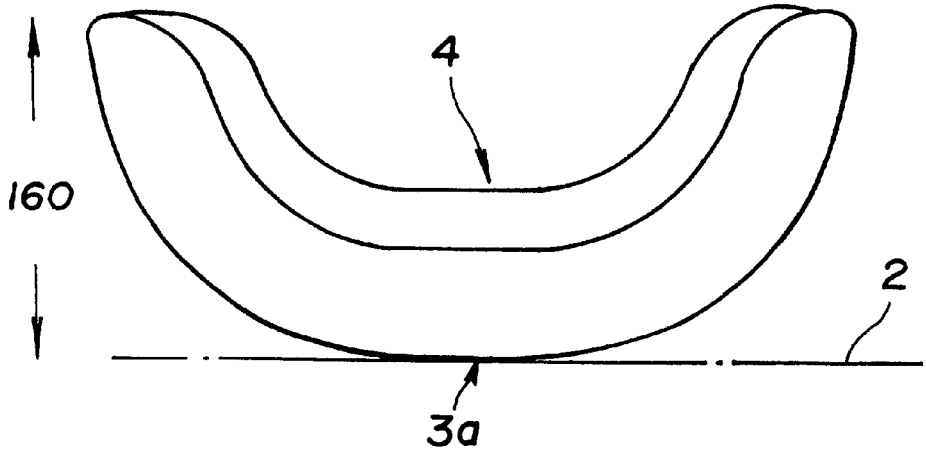
FIG. 7 is a rear view showing the pillow of the third embodiment of FIG. 6.
Figure 8:
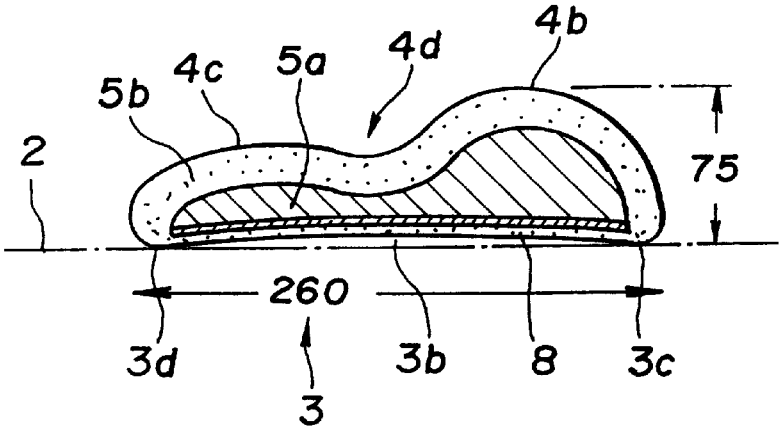
FIG. 8 is a sectional view showing the third embodiment of FIG. 6, taken along a spinal column of a user.

In the embodiments of FIGS. 1–3 and FIGS. 4 and 5, the pillow is a convex arc at the lower surface 3*a* of the central portion, seen from the side. On the other hand, an embodiment of FIGS. 6–8 is horizontal at its central lower surface portion 3*a,* as best shown by FIG. 7. When the central lower surface portion 3*a* is horizontal as shown, it is advantageous in that this horizontal portion 3*a* contacts with a floor 2 and the pillow is easy to be stable in an upwardly-opened semi-circular concave state.

On the other hand, when a pillow is arc at its central lower surface portion 3*a* as shown by FIGS. 1–3 and FIGS. 4 and 5, it is advantageous in that the pillow can easily swing, although it is poor in its stability.

FIG. 8 is a sectional view taken along a spinal column of a user, and a lower surface 3 of the pillow is concaved arc. Namely, in the lower surface 3 of the pillow, a feet side portion 3*c* and a side portion 3*d* are more projected toward the floor 2 than a central portion 3*b* so that only both side portions 3*c* and 3*d* contact with the floor 2.

The pillow takes this shape almost along the total length until both ends of the pillow, which prevents a change of a direction of the pillow to be out of place when it swings together with user's turning over and maintains an angle of the pillow constantly relative to the spinal column of the user.

The semi-circular concave shape is held more confidently, when a reinforcing member such an iron plate 8 is attached along the lower side of the inner body 5*a* of hard synthetic resin. In FIGS. 6–8, for exemplifying purpose, sizes of parts are shown in millimeter.

Embodiment 4

FIG. 9 is a sectional view showing an embodiment provided with bumps, taken along a spinal column of a user. On whole surface 4 of a semi-circular concave upper surface, are formed many hemisphere bump-like projections 6 of a golf ball size for example. When these projections 6 push effective pressure points in backs of a user's neck and head, the pressure points are stimulated to give a pleasant feeling and have therapeutic effect.

This pillow is made to be hollow in its inside. In the case of such hollow structure, there may be opened many holes 7 communicated to the outside so that fresh air enters into the inside of the pillow, which improves air-permeability. Further, by covering the outside of the hollow inner body 5*a* with a layer of softer synthetic resin, the pillow can be made not to stimulate backs of a neck and head too strongly.

The pillow according to the present invention may be provided with a height adjusting mechanism on the lower side of the pillow so that the height of the pillow is freely adjusted according to a user. Further, when it is to be used for remedy, size and shape of the pillow may be arranged to fit a body shape and size of a patient.

Embodiment 5

Figure 10:
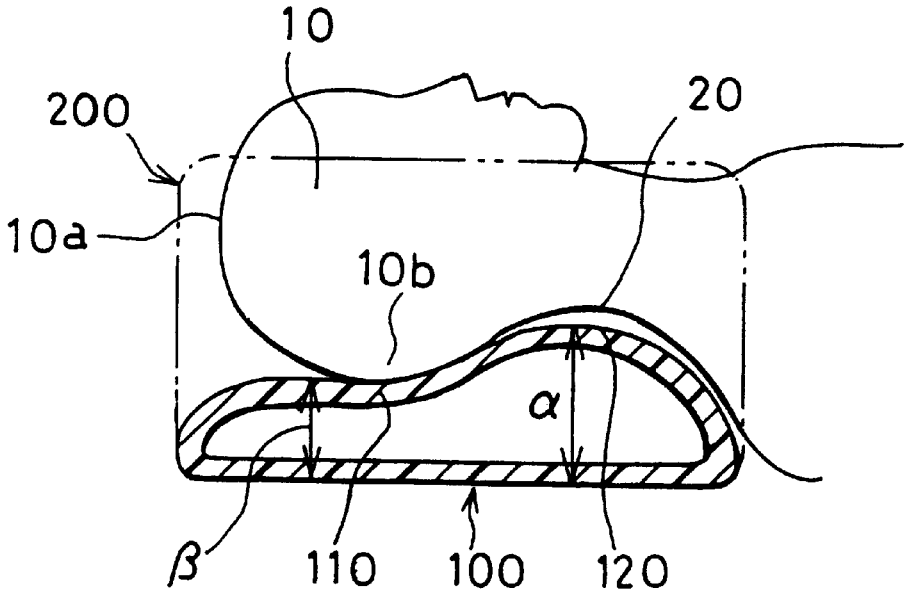
FIG. 10 is a partially sectional view showing a state of use of a swinging pillow according to the fifth embodiment of the present invention.
Figure 11:
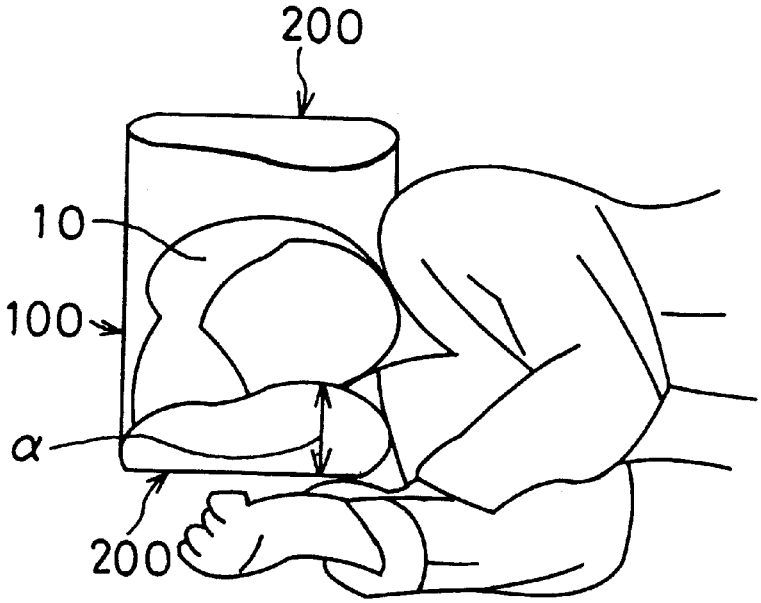
FIG. 11 is a side view showing a state of use of the swinging pillow of the fifth embodiment of the present invention.
Figure 12:
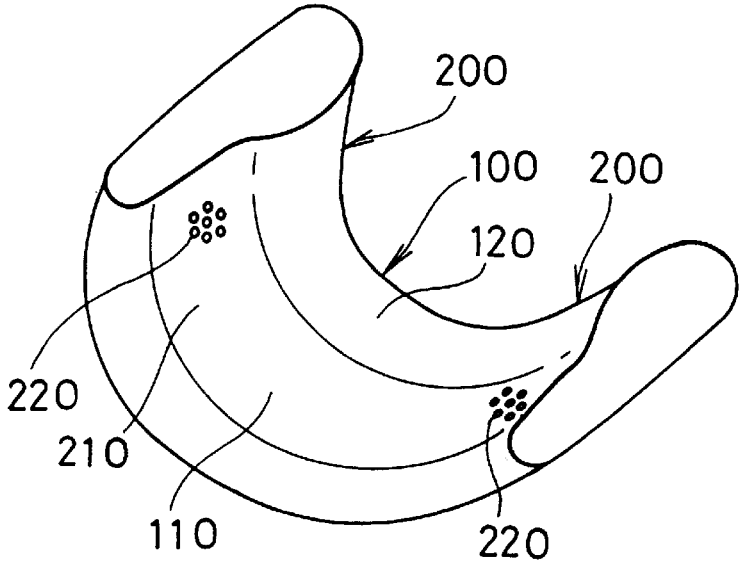
FIG. 12 is a general perspective view showing the swinging pillow of the fifth embodiment of the present invention.
Figure 13:
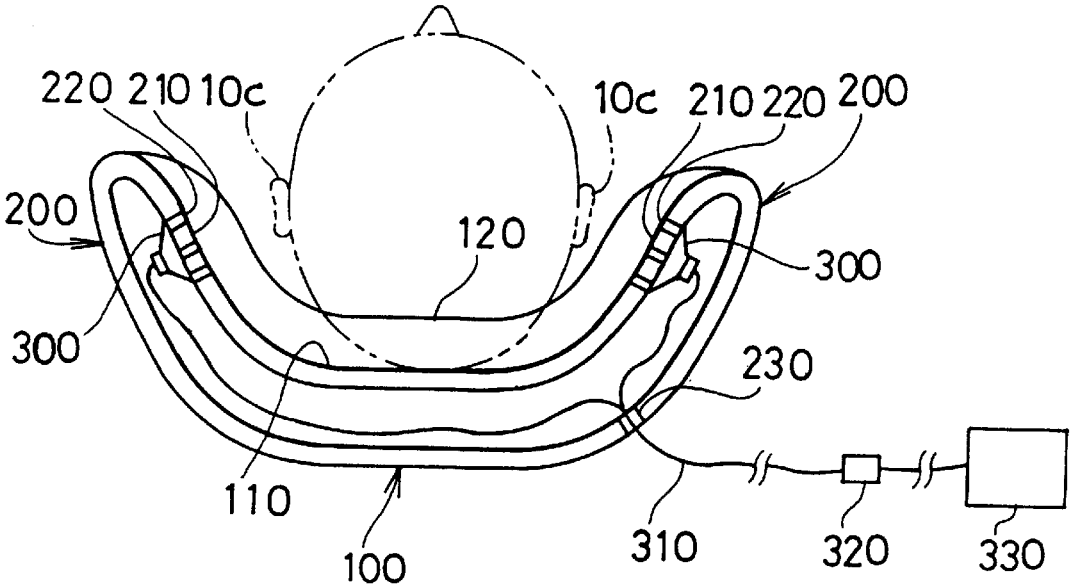
FIG. 13 is a sectional view taken along A—A line in FIG. 12.

FIGS. 10–13 show the fifth embodiment of the present invention: FIGS. 10 and 11 show a state in use, respectively in a partially sectional view and a side view; FIG. 12 is a perspective view generally showing the swinging pillow; and FIG. 13 is a sectional view taken along A—A line in FIG. 12.

As seen from these figures, the swinging pillow according to the fifth embodiment comprises a pillow body 100 for accepting a user's head 10, and left and right rising portions 200, 200 formed respectively as rising end portions positioned at the ends in the direction of breadth of a user's shoulders. As shown in FIGS. 12 and 13, the pillow is curved as a whole to be generally U-shaped seen from the side 10*a* of the user, and the whole portion of the pillow functions as a pillow. Further, inside the left and right rising portions 200, 200, there are provided sound sources 300.

Next, details of the pillow will be described.

The pillow body 100 and the left and right rising portions 200 are hollow, and the whole of them is formed of harder synthetic resin. Although, of course, the pillow may be formed of other material, synthetic resin is preferable from the viewpoint of productivity and costs. When synthetic resin is used, a layer of soft synthetic resin may be formed on all over the inner surface accepting a head 10 of a user to have a cushion effect. This cushion effect may be given by a pillowcase which is not shown.

As shown in FIG. 10, the pillow body 100 comprises a flat portion 110 for accepting a back of a head 10*b* and a mountain-like portion 120 raised up in a shape generally corresponding to a curved shape of a back 20 of a neck of a user. The mountain-like portion 120 and flat portion 110 are smoothly continued. Further, the left and right rising portions 200, 200 have a similar profile in section as the body 100. Thus, the pillow has such a shape as if there existed pillow portions similar to the pillow body 100 continuously on both sides of a user.

By this, the pillow does not drop out of the head 10 even when the pillow is displaced slightly or a user's body moves in response to a change in posture. Accordingly, the pillow is suitable for an unruly sleeper. Further, when a user has turned over, the pillow swings, as a whole, to the state of use shown in FIG. 11. In the case when the pillow swings sideways, one of the rising portions 200 lies sideways to function as a pillow, and therefore, the user does not slip out of the pillow.

The pillow is so constructed that, in the state that a user lies on his back with his head 10 being received by the pillow body 100, there exist sufficient spaces between inner surfaces 210, 210 of both rising portions 200, 200 and the user's ears 10*c*, 10*c*. This is intended not to give a blocked feeling or oppressive feeling due to the presence of the existence of both rising portions 200, 200.

In the present embodiment, there are provided a pair of speakers 300, 300 as sound sources within both rising portions 200, 200, insides of which are hollow. In the example shown, each rising portion 200 has a plurality of openings 220 at a location closer to an ear of the user in the inner surface 210 of the rising portion 200 for leading sound from a speaker 300 to the outside adjacent to the ear 10*c*, and the speaker 300 is provided at a position corresponding to the openings 220. By this construction, even if the sound from the speaker 300 is made very low, it can be led to the outside without being so lowered that a user can not listen to it. Thus, as very low sound can be listened to in the neighborhood of both ears, the pillow functions like a headphone.

Although one opening 220 may be used, it is preferable that a plurality of smaller openings are provided, as shown, since the smaller openings can prevent intrusion of foreign body, etc.

Lead wire 310 of the pair of speakers 300, 300 is pulled out through a hole 230 to the outside, and connected, through a connector 320, to an amplifier 330 of a sound equipment provided with, for example, a radio tuner, CD player, tape player, etc. Of course, a dedicated sound device may be employed. In either case, it is sufficient to reproduce sound or a musical piece which is effective for therapeutic treatment or relaxation or as an aid for falling asleep, etc. Thus, the present invention is not limited by the detailed examples.

Embodiment 6

Figure 14:
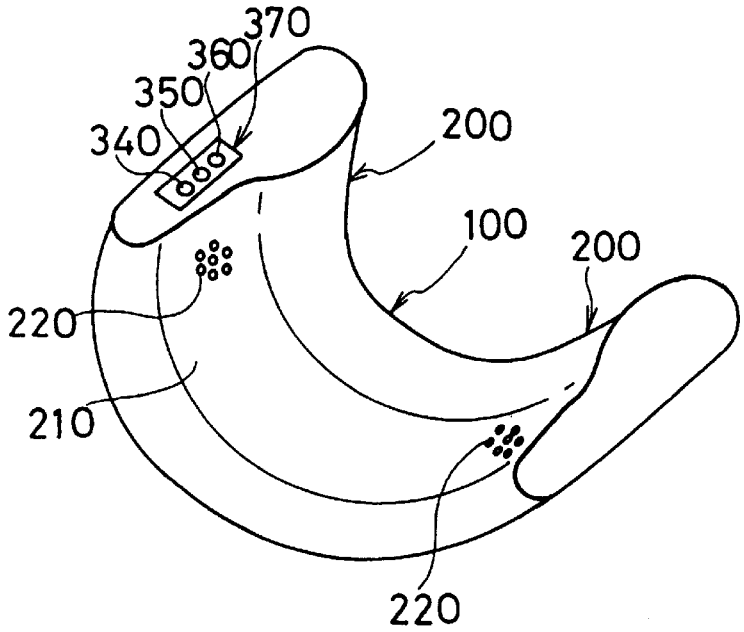
FIG. 14 is a perspective view showing the sixth embodiment of the present invention.
Figure 15:
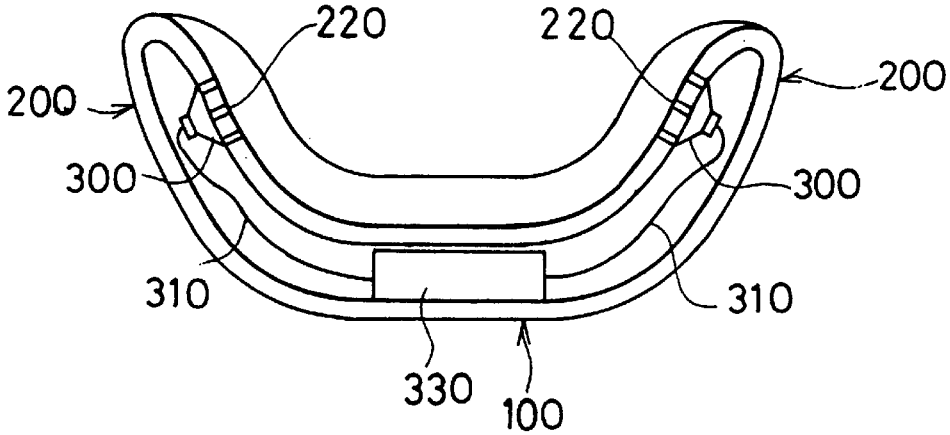
FIG. 15 is a sectional view of the sixth embodiment of the present invention.

FIGS. 14 and 15 are a perspective view and a sectional view showing the sixth embodiment of the present invention provided with a built-in amplifier. In this embodiment, inside a pillow body 100, an amplifier 33 is built in, and connected to speakers 300, 300 through lead wires 310, 310.

In such a type with a built-in amplifier, it is needed to provide an outside manipulating portion. Accordingly, as shown in FIG. 14, there is provided with a manipulating portion 370 including a volume adjusting means (button) 340 for the speakers 300, a band switching means 350, a power switch 360, and the like. This manipulating portion 370 is provided in an upper surface 200*a* of one of the rising portions 200. By this, a user can freely manipulate the amplifier while he lies in bed. In this case, an opening may be provided on a lower surface of the pillow body 200 for exchanging batteries, or a cord for using commercial electric supply may be pulled out.

Embodiment 7

Figure 16:
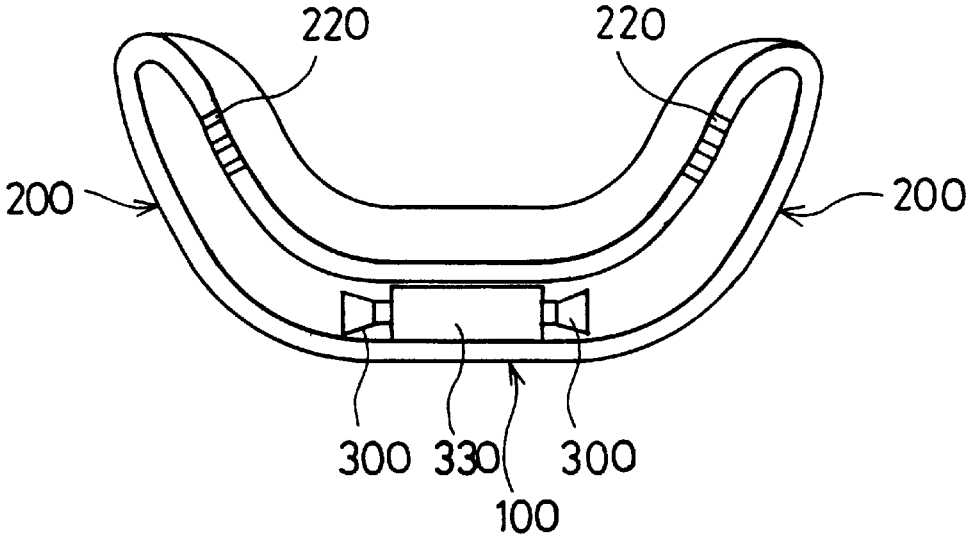
FIG. 16 is a sectional view showing the seventh embodiment of the present invention.

FIG. 16 is a sectional view showing the seventh embodiment of the present invention. In this embodiment, an amplifier 330 is placed within a pillow body 100, and on left and right sides of the amplifier, there are provided speakers 300, 300 directed toward the rising portions 200, 200, respectively. In this construction, the whole sound source can be housed compactly. Further, it has an effect of reinforcing the pillow body 100, also. In addition, since the rising portions 200, 200 are hollow in their insides, those portions serve as speaker boxes for the speakers 300, thus improving the sound quality.

Embodiment 8

Figure 17:
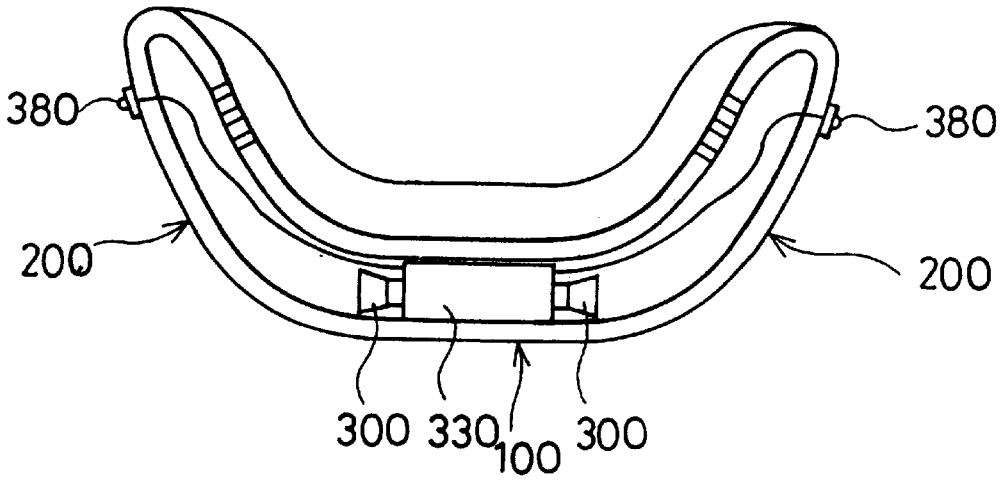
FIG. 17 is a sectional view showing the eighth embodiment of the present invention.

FIG. 17 is a sectional view showing the eighth embodiment of the present invention. In this embodiment, power on-off means 380, 380 are provided in rising portions 200, 200, so that one on a lower side is turned off when a user turns over to lie on his side. Preferably, the on-off means 380, 380 are provided on the outer surfaces of the rising portions 200, respectively. This is because, it is possible to employ such construction that, when a user turns over, one of the rising portions 200, 200 lies sideways contacting with a floor, and the on-off means on the lower side is turned off in a push button manner utilizing the weight of user's head and weight of the pillow.

Regarding the on-off means 380, another construction may be employed. For example, a piezoelectric element may be used to provide a mechanism for generating an off signal by utilizing the above-described weights when the user turns over. For reuse after the off operation, a reset switch may be provided. Because of this construction, even when a user falls asleep while sound is being transmitted or during the playing of a musical song, power can be turned off in the course of sleeping. Instead of the on-off means 380, a timer may be provided, although not shown here.

In the above-described embodiments, such examples are shown that the pillow body 100 and the rising portions 200 are hollow. Of course, the pillow may be constructed so that foamed resin or other similar material is filled for example, if necessary for maintaining a shape as a whole or for weight saving.

Further, as for a sound source, a wire type as been illustrated. Of course, it is possible to employ a wireless type sound source. In that case, it is possible to eliminate the lead wire which leads to the outside, improving safety and convenience of use.

According to the present invention defined in claim 1, a swinging pillow is semi-circular and concave in shape, thus the whole portion functions as a pillow. Thus, when a user lies on his back, the semi-circular concave pillow is upwardly opened. When a user turns over to lie on his side, the semi-circular concave pillow swings together with the user's head so that the semi-circular concave pillow is opened sideways.

Even when a user lies on his side, he does neither slide out of the pillow nor assume an unnatural posture since the whole portion of the pillow functions as a pillow. Accordingly, the user can have a good sleep as in the case where he lies on his back. Thus, the pillow according to the present invention is one suitable for turning over, for promoting circulation of blood, and for maintaining the correct user backbone position.

Further, since the pillow of the present invention has the semi-circular concave shape, when a user lies on his back, lower surfaces of both sides of the pillow are spaced from the floor and both shoulders of the user are lifted so that it has an effect of removing the strain of the shoulders. Further, because of its semi-circular concave shape, it has an effect of preventing the displacement and slipping of a user's head out of the pillow, even for a person who tosses to some degree in his sleep.

According to claim 2, the area on the side receiving a back of a neck of a user is higher than the any other area. Because of this construction, the pillow not only contributes to the stability of the user's head and a comfortable feeling in bed when the user lies on his back, but also makes the back of the neck curved forwardly in its proper shape, giving a therapeutic on effect while the user sleeps.

According to claim 3, the lower side of the central portion of the pillow is a convex arc. In that case, when a user turns over to lie on his side, the pillow can easily swing together with the turning of the user's head. Thus, it is easy for the semi-circular concave pillow of this type to swing or turn.

According to claim 4, the lower side of the central portion of the pillow is horizontal. In this case, stability of the pillow is good when a user lies on his back. In stead, this pillow needs more strength to swing or turn when a user turns over to lie on his side.

According to claim 5, the lower surface of the pillow is a concaved arc. As a result, the pillow swings or turns in a direction just perpendicular to the spinal column of the user when it swings along with the user's turning over. Thus, the pillow is not displaced as it swings, and the user can sleep while maintaining a normal posture.

According to claim 6, the inside of the pillow is made of harder synthetic resin, so that the structure and shape of the pillow can be held fixedly. Further, a user's head contacts with the upper surface covered with softer synthetic resin so that the stimulation given to the back of the neck and head of the user is not too strong.

According to claim 7, a plurality of projections are formed on the upper surface of the pillow for stimulating effective pressure points of a user. In this case, these projections stimulate effective pressure points in the back of the user's neck and head, when the semi-circular concave pillow swings or the user turns over, thus promoting blood circulation and increasing the therapeutic effect further.

Further, according to the present invention, there has been provided a technique, in which, in addition to directing attention to a shape of a swinging pillow which can maintain the position a user's backbone in good position and can make user's turning over easy, the pillow has a built-in sound source in its inside so that the pillow can be used also for transition to relaxation or for the purpose of treatment such as solving sleeplessness, and has a function equal to or near to a function of an earphone or headphone, without employing those devices in addition to a pillow. In particular, effectively utilizing the pillow body or the left and right rising portions for the sound source, low sound or musical selections can serve these purposes.

Further, the sound source may be provided with a manipulating portion including a volume adjusting means for the speakers, a band switching means and the manipulating portion may be provided at one of the rising portions. By this construction, a user can conveniently operate the sound source while he lies in bed. Further, the pillow may be provided with an on-off means for turning off the sound source when a user turns over. Accordingly, even when a user falls asleep while playing sound or a musical selection, power can be turned off in the course of sleeping.

The Other Embodiments

According to an embodiment corresponding to claim 20, (a) weight(s) 390 is(are) provided in said lower portion of the pillow 101.

Further, according to an embodiments corresponding to claim a buckwheat-chaff(s), a paddy chaff(s), a charcoal, an activated carbon(s), or a tip(s) of Japanese cypress is(are) filled with a inner portion of the pillow.

Figure 18:
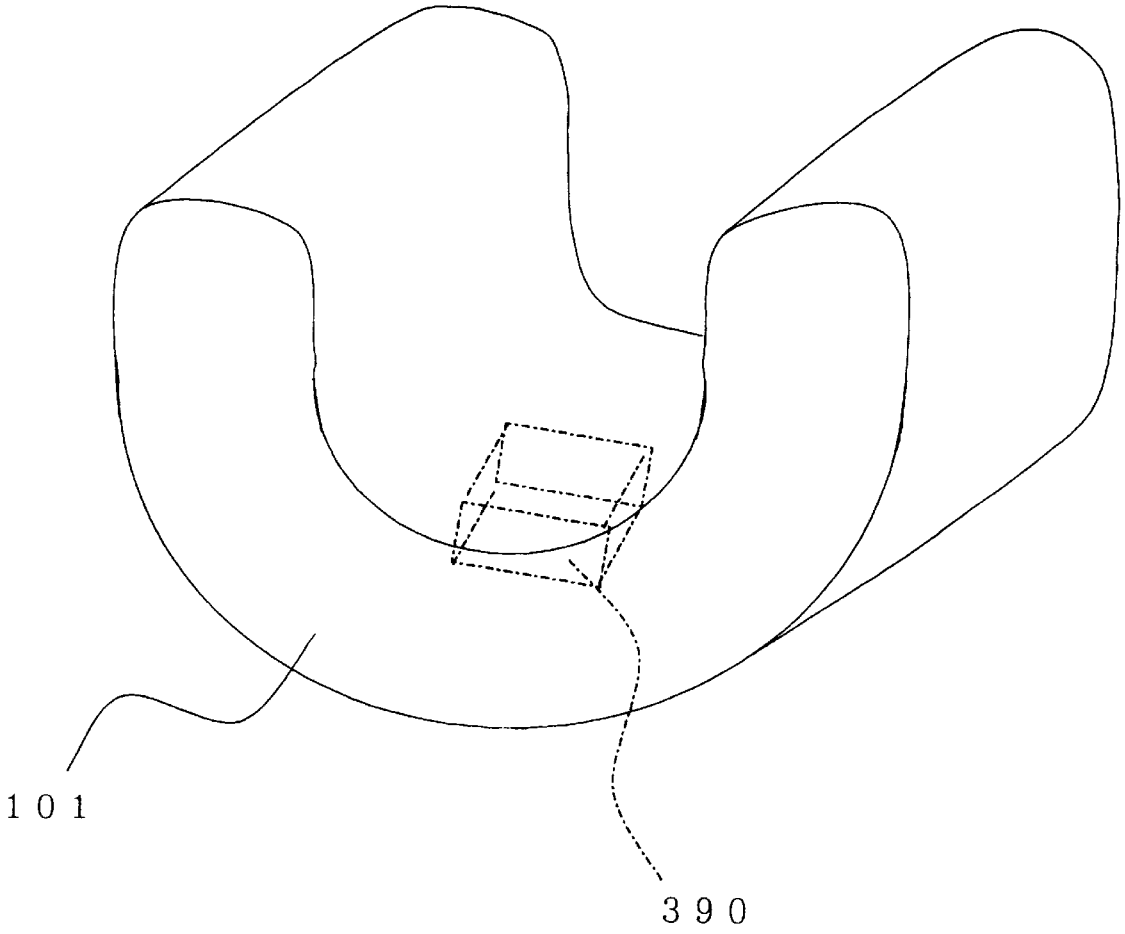
FIG. 18 is a perspective view showing another embodiment of the invention that includes a weight.

As shown in FIG. 18, a weight(s)390 is(are) full in Swinging Pillow 101.

Figure 19:
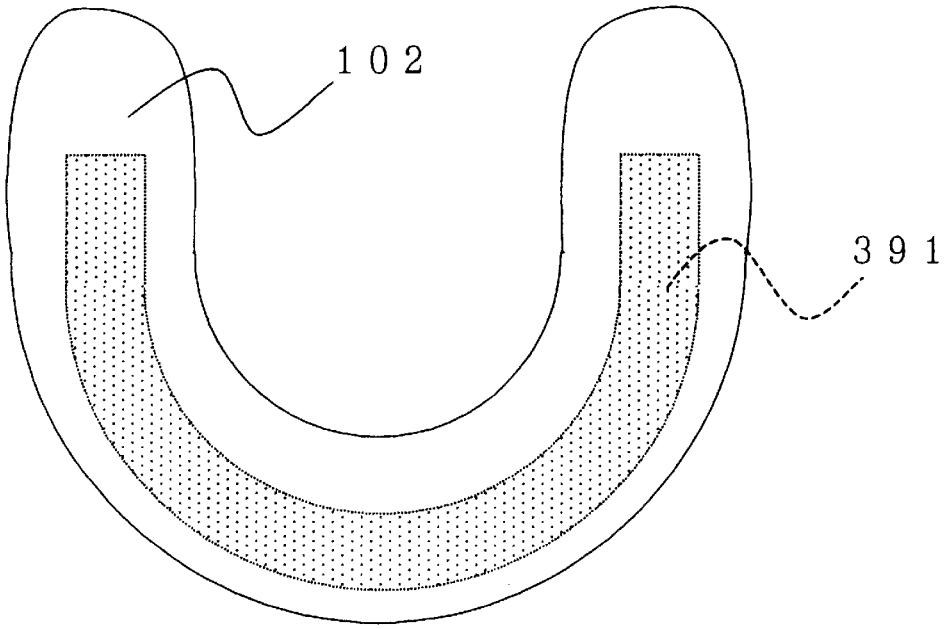
FIG. 19 is a front view showing another embodiment of the invention that includes buckwheat-chaff.

As shown in FIG. 19, a buckwheat-chaff(s)391 is(are) full in Swinging Pillow 102.

Figure 20:
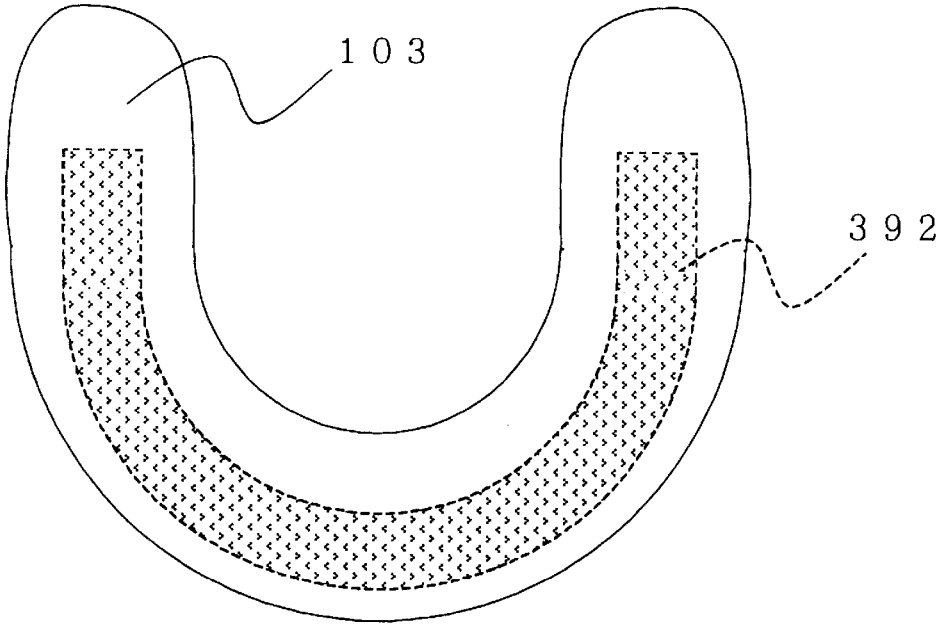
FIG. 20 is a front view showing another embodiment of the invention that includes paddy-chaff.

As shown in FIG. 20, a paddy-chaff(s)392 is(are) full in Swinging Pillow 103.

Figure 21:
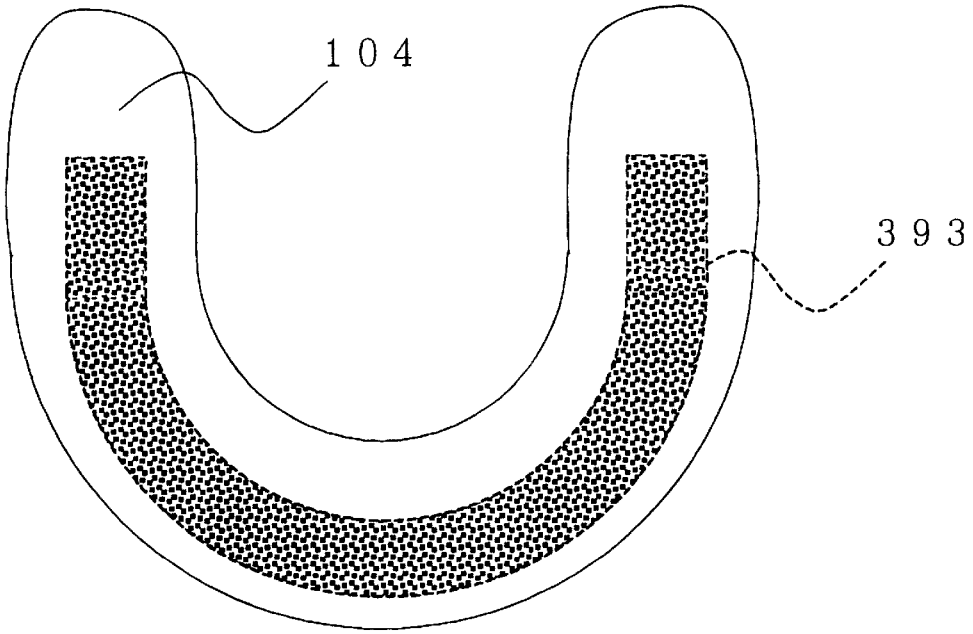
FIG. 21 is a front view showing another embodiment of the invention that includes charcoal.

As shown in FIG. 21, a charcoal 393 is(are) full in Swinging Pillow 104.

Figure 22:
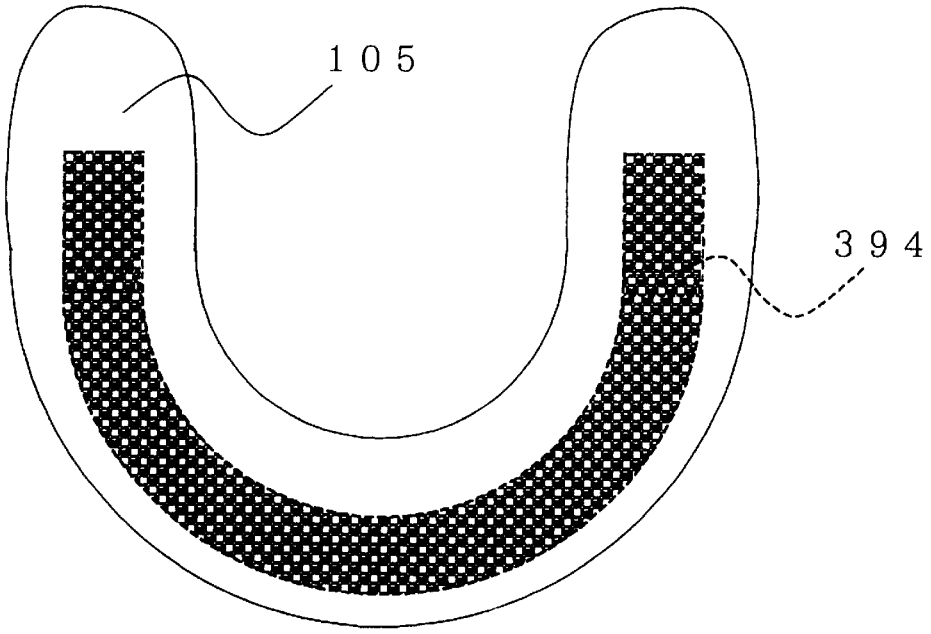
FIG. 22 is a front view showing another embodiment of the invention that includes activated carbon.

As shown in FIG. 22, an activated carbon(s)394 is(are) full in Swinging Pillow 105.

Figure 23:
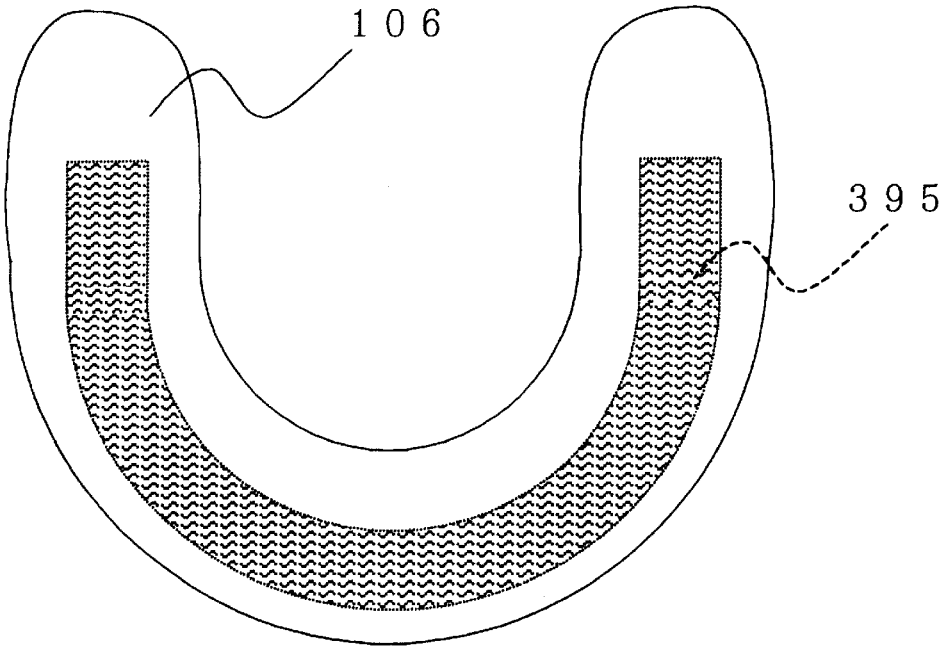
FIG. 23 is a front view showing another embodiment of the invention that includes tips of Japanese cypress.

As shown in FIG. 23, a tip(s) of Japanese cypress 395 is(are) full in Swinging Pillow 106.

What is claimed is:

1. A swinging pillow which is generally semi-circular and concave for supporting a user's head, wherein the pillow comprises:

first and second end portions; a lower convex surface extending between the first and second end portions; and an upper concave surface extending between the first and second end portions to define two upper end portions and a central portion adapted to receive a user's head; and wherein the pillow has a first position wherein the first and second end portions are vertically above the central portion and wherein the first and second end portions are spaced from the user's head; and wherein the pillow has a second position wherein a first end portion is vertically above the central portion and a second end portion is vertically below the central portion and wherein the first end portion is spaced from the user's head and the second end portion contacts the user's head.

2. The pillow according to claim 1, wherein a portion on the surface receiving a tape of a user's neck is higher than any other area of said surface.

3. The pillow according to claim 1, wherein the lower surface of the pillow has a central portion that comprises a continuously convex arc when viewed from the crown of the user's head.

4. The pillow according to claim 1, wherein the lower surface of a central portion of the pillow is horizontal.

5. The pillow according to claim 1, wherein the lower surface of the pillow is a concave arc.

6. The pillow according to claim 1, wherein an inside of the pillow is made of hard synthetic resin with a layer of soft synthetic resin is on at least on the upper surface of the pillow.

7. The pillow according to claim 1, wherein a plurality of projections are formed on the upper surface of the pillow for stimulating pressure points of a user's head and neck.

8. A swinging pillow comprising:

a pillow body having first and second ends and a surface extending between the first and second ends for receiving and supporting a user's head, the pillow body being curved and generally U-shaped; and wherein the pillow has a first position wherein the end portions are vertically above the central portion and wherein both of the end portions are spaced from the user's head; and wherein the pillow has a second position wherein a first end portion is vertically above the central portion and a second end portion is vertically below the central portion and wherein the first end portion is spaced from the user's head and the second end portion contacts the user's head.

9. The pillow according to claim 8, wherein there are spaces between inner surfaces of the left and right rising portions and the user's ears when the user lies on his back with his head being received by the pillow body.

10. The pillow according to claim 8, wherein insides of said left and right rising portions are hollow and there are provided one or more openings at those rising portions for allowing sound to be transmitted from a sound source to outside of the pillow body.

11. The pillow according to claim 10, wherein said openings are positioned in the inner surfaces of the rising portions close to user's ears.

12. The pillow according to claim 10, wherein there are a plurality of openings in each of the rising portions.

13. The pillow according to claim 8, wherein a sound source includes one or more speakers.

14. The pillow according to claim 13, wherein said speakers are provided close to openings.

15. The pillow according to claim 8, wherein a sound source is provided with an amplifier connected to a speaker (s), and an amplifier is housed within the pillow body or the rising portions.

16. The pillow according to claim 8, wherein a sound source is provided with a manipulating portion which includes a volume adjusting means for the speakers, a band switching means and is located on one of the rising portions in such a manner that the portion can be operated from outside of the pillow body.

17. The pillow according to claim 8, wherein there are provided in said rising portions a means for turning off a sound source when the user turns over onto his side.

18. The pillow according to claim 17, wherein said means include an on-off device.

19. The pillow according to claim 17, wherein said means includes at least one timer.

20. The pillow according to claim 1, wherein at least one weight is provided in said lower portion.

21. The pillow according to claim 8, wherein at least one weight is provided in a bottom portion of said U-shape.

22. The pillow according to claim 1, wherein an inner portion is filled with buckwheat.

23. The pillow according to claim 1, wherein an inner portion is filled with paddy chaff.

24. The pillow according to claim 1, wherein an inner portion contains charcoal.

25. The pillow according to claim 1, wherein an inner portion contains activated carbons.

26. The pillow according to claim 1, wherein an inner portion is filled with Japanese cypress.

* * * * *